US007650820B2

(12) United States Patent
Hsieh

(10) Patent No.: US 7,650,820 B2
(45) Date of Patent: Jan. 26, 2010

(54) HANDLED TOOL

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 43 days.

(21) Appl. No.: 11/863,242

(22) Filed: Sep. 27, 2007

(65) Prior Publication Data

US 2009/0084228 A1 Apr. 2, 2009

(51) Int. Cl.
*B25B 23/16* (2006.01)

(52) U.S. Cl. ..... 81/177.1; 81/900; 81/436

(58) Field of Classification Search ..... 81/177.1, 81/177.2, 900, 436–439, 177.85, 184; 16/110.1
See application file for complete search history.

(56) References Cited

U.S. PATENT DOCUMENTS 1,170,709 A * 2/1916 Thomson ..... 81/436
1,755,822 A * 4/1930 Hobbs ..... 81/436
2,609,851 A * 9/1952 Hadfield ..... 81/489
2,899,996 A * 8/1959 Stockman ..... 81/177.1
6,427,563 B1 * 8/2002 Zurbuchen et al. ..... 81/177.1
6,606,925 B1 * 8/2003 Gmeilbauer ..... 81/177.1
7,272,997 B1 * 9/2007 Lee et al. ..... 81/177.1

* cited by examiner

*Primary Examiner*—D. S Meislin
(74) *Attorney, Agent, or Firm*—Guice Patents PLLC

(57) ABSTRACT

A handled tool with a firm structure comprises a driving portion having a driving end and a connecting end; the driving end being an operation end of the handled tool; an enlarged annular portion being below the driving end; a coarse section being between the annular portion and the connecting end; an extending unit being a rod; the extending unit having a first extending end and a second extending end; the first extending end being combined to the embedding groove of the driving portion; and a handle portion having a enclosing cover and a handle, in assembly, the first extending end of the extending unit being combined to the connecting end; the second extending end of the extending unit being received in the handle portion; the enclosing cover enclosing a portion of the extending unit protruded from the handle portion and a portion of the driving portion.

11 Claims, 6 Drawing Sheets

HANDLED TOOL

FIELD OF THE INVENTION

The present invention relates to hand tools, and particular to a handled tool which has a firmly structure between the driving portion and the handle so that the lifetime of the handled tool is prolonged.

BACKGROUND OF THE INVENTION

Generally, a handled tool has a driving portion and a handle. In manufacturing process, the driving portion is placed in a mold and then the handle is formed with the driving portion by molding injection so that the handle encloses the driving portion. Thus the driving portion is firmly secured to the handle without vibration in operation or sliding.

U.S. Pat. No. 5,964,009 discloses a hand tool comprising: a relatively hard and rigid inner body of unitary one-piece construction having an elongated central portion and two end flanges extending laterally outwardly of the central portion around the entire periphery thereof, the central portion having a peripheral annular groove formed therein adjacent to an end flange, and an outer gripping body formed of a relatively soft and flexible material surrounding the central portion of the inner body and terminating at the end flanges and filling the groove, and each of the inner body and the outer gripping body having an outer surface which is non-circular in transverse cross section.

However, generally, the driving portion of the prior art handle has a round shape so that it easily slides with respect to the handle. However, in operation, the driving portion is driven to rotate so that after the handle is used for a long time, the connection of the driving portion and the operation, the driving portion is driven to rotate so that after the handle is used for a long time, the connection of the driving portion and the handle will become loose so that it can not well function.

SUMMARY OF THE INVENTION

Accordingly, the primary object of the present invention is to provide a handled tool which has a firmly structure between the driving portion and the handle so that the lifetime of the handled tool is prolonged.

To achieve above objects, the present invention provides a handled tool with a firm structure comprising: a driving portion having a driving end and a connecting end; the driving end being an operation end of the handled tool; an enlarged annular portion being below the driving end; a coarse section being between the annular portion and the connecting end; an extending unit being a rod with rectangular cross section; the extending unit having a first extending end and a second extending end; the first extending end being combined to the embedding groove of the driving portion; and a handle portion having a enclosing cover and a handle, in assembly, the first extending end of the extending unit being combined to the connecting end of the driving portion; the second extending end of the extending unit being received in the handle portion; the enclosing cover enclosing a portion of the extending unit protruded from the handle portion and a portion of the driving portion below the annular portion of the driving portion so that the annular portion will resist against an upper edge of the enclosing cover.

In the present invention, the coarse section and the extending unit having a rectangular cross section have the effect of securing the driving portion and extending unit firmly to the handle portion so has a concrete structure. The annular portion has the effect of retaining the enclosing cover without sliding.

The various objects and advantages of the present invention will be more readily understood from the following detailed description when read in conjunction with the appended drawing.

DETAILED DESCRIPTION OF THE INVENTION

Figure 1:
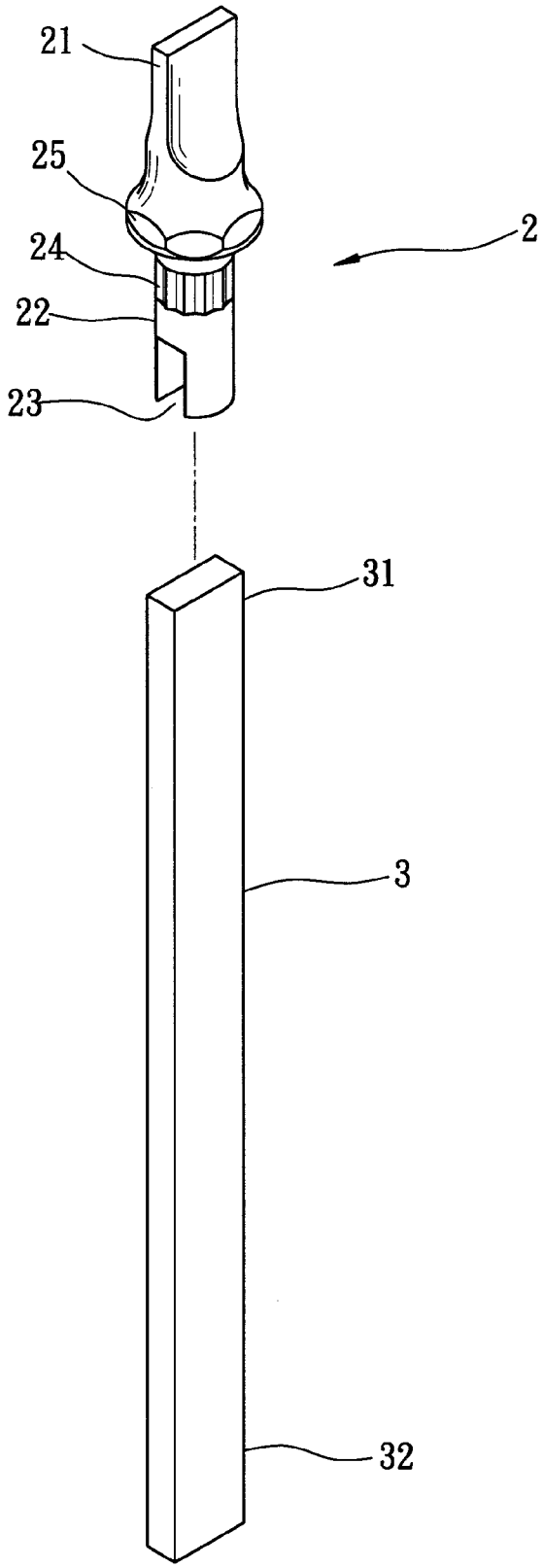
FIG. 1 is an exploded schematic view of the handled tool of the present invention.
Figure 2:
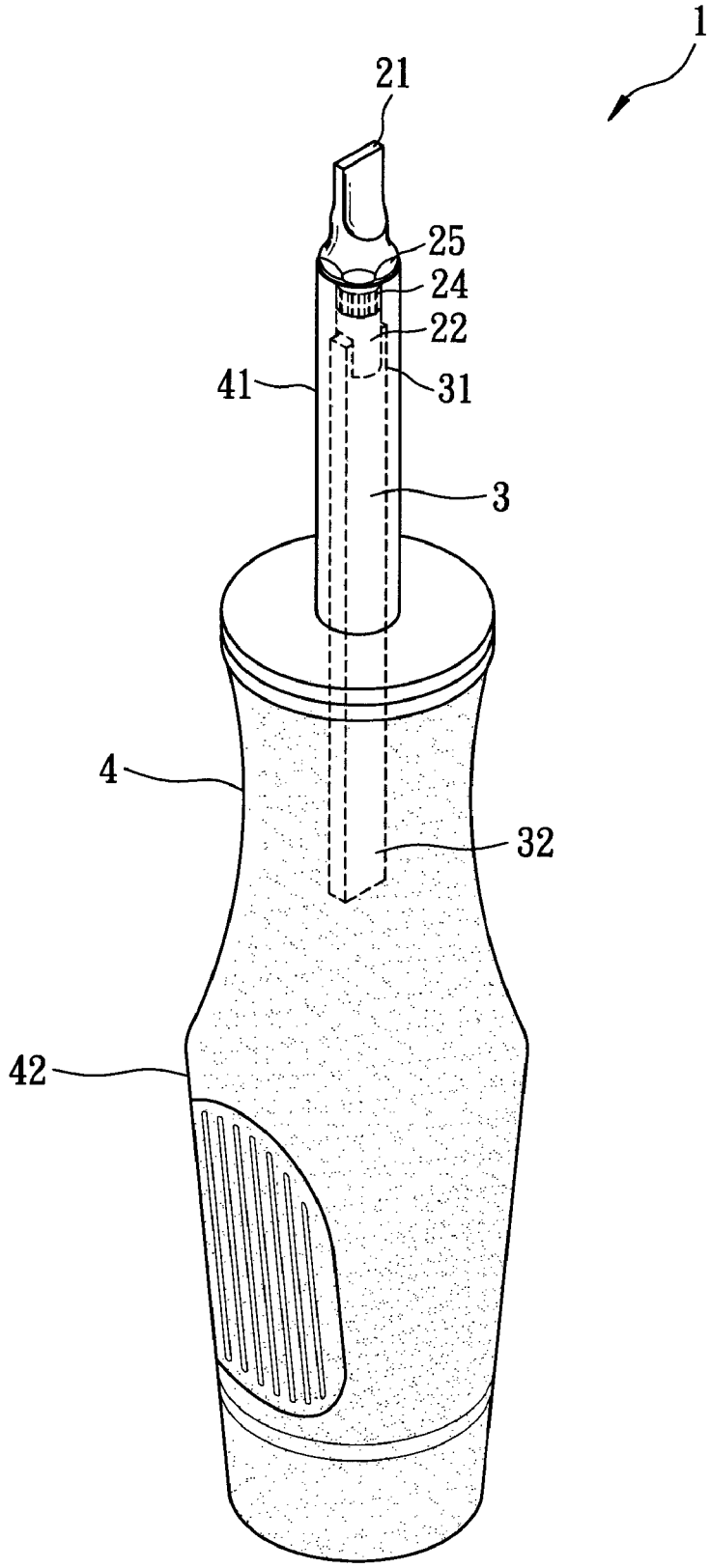
FIG. 2 is a schematic perspective view of the handled tool of the present invention.
Figure 3:
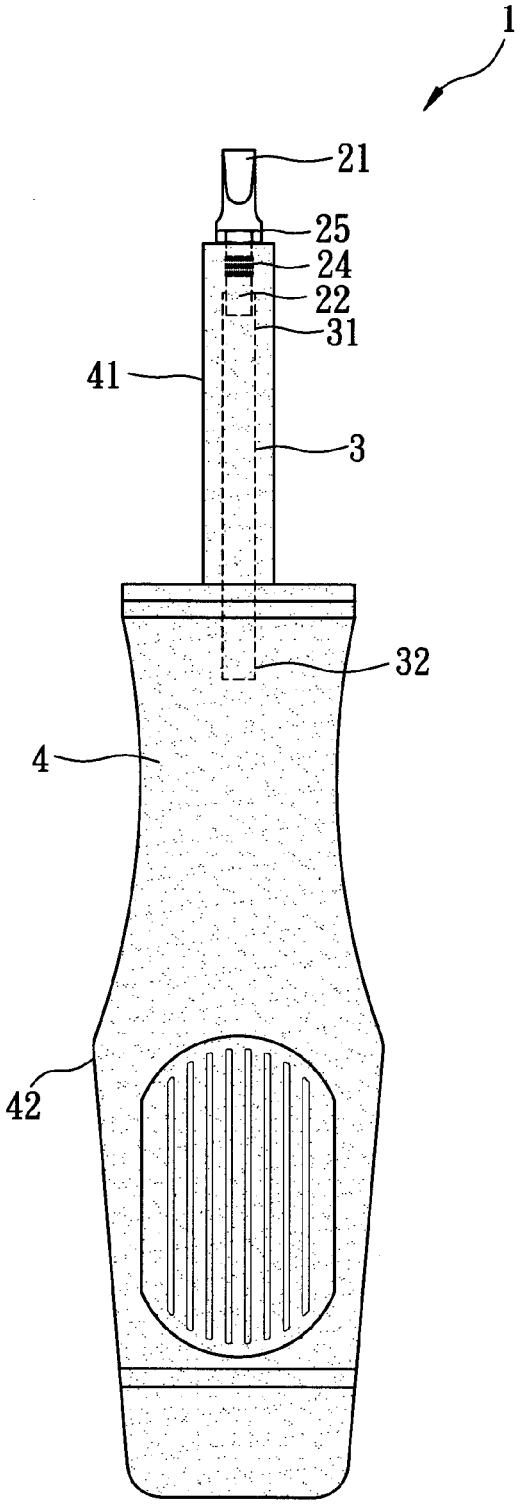
FIG. 3 is a schematic view of the handled tool of the present invention.
Figure 4:
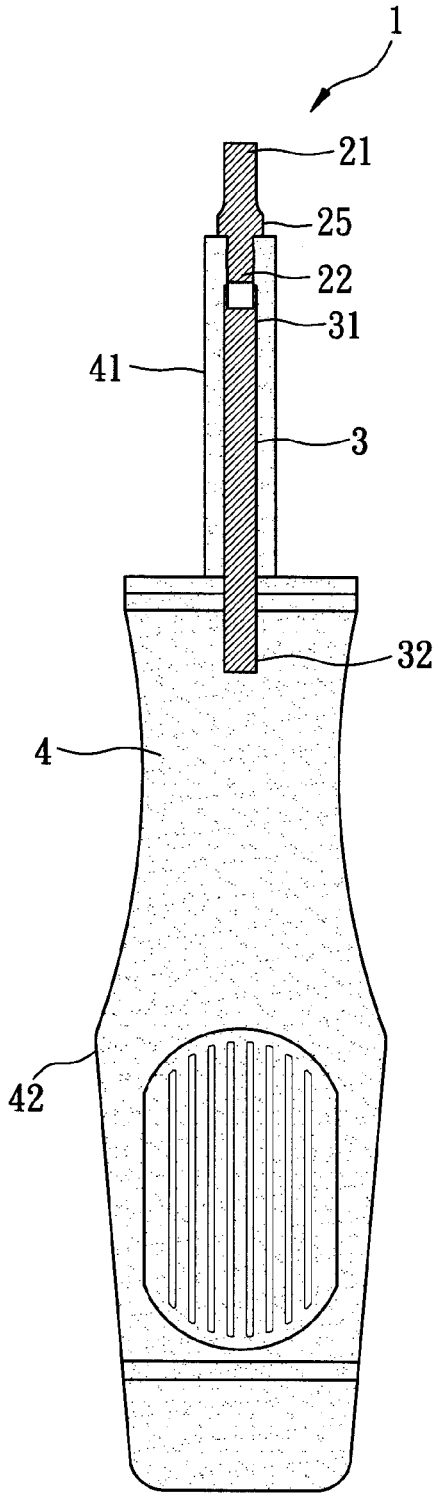
FIG. 4 is a schematic cross sectional view of the handled tool of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the structure 1 of the present invention is illustrated. The present invention has the following elements.

A driving portion 2 has a driving end 21 and a connecting end 22. The driving end 21 is an operation end of the handled tool. In this embodiment, the driving end 21 is a straight end opener. The connecting end 22 is a round cylinder. A distal end of the connecting end 22 has a concave embedding groove 23 with a rectangular cross section. An enlarged annular portion 25 is below the driving end 21. A coarse section 24 is between the annular portion 25 and the connecting end 22.

An extending unit 3 is a rod with rectangular cross section. The extending unit 3 has a first extending end 31 and a second extending end 32. The first extending end 31 is combined to the embedding groove 23 of the driving portion 2.

A handle portion 4 has an enclosing cover 41 and a handle 42. In assembly, the first extending end 31 of the extending unit 3 is received in the embedding groove 23 of the driving portion 2. The second extending end 32 of the extending unit 3 is received in the handle portion 4. The enclosing cover 41 encloses a portion of the extending unit 3 protruded from the handle portion 4 and a portion of the driving portion 2 below the annular portion 25 of the driving portion 2 so that the annular portion 25 will resist against an upper edge of the enclosing cover 41.

In the present invention, the enclosing cover 41 and handle 42 can be made integrally by molding injection so that the enclosing cover 41 and handle 42 are formed as an integral body.

Figure 5:
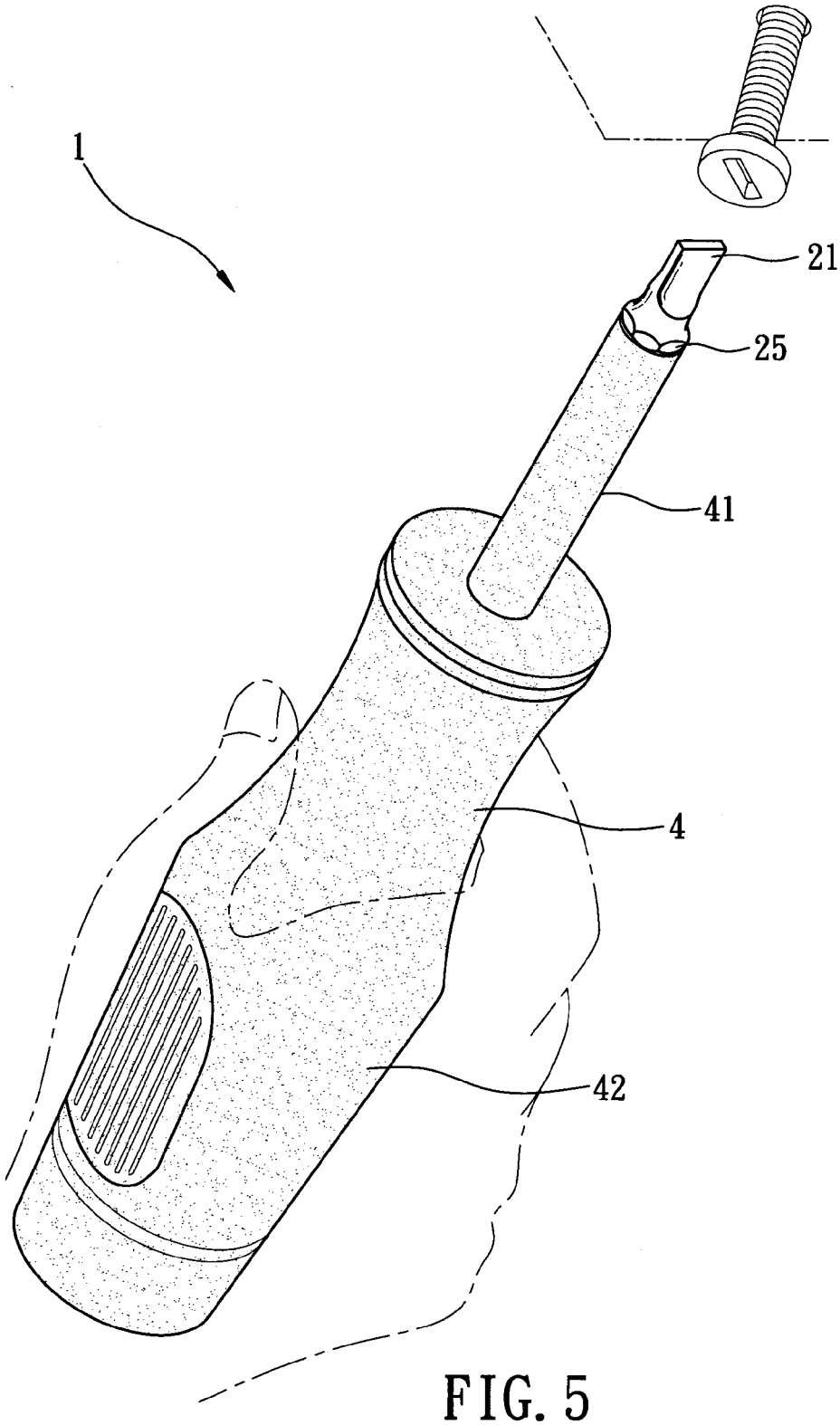
FIG. 5 is a schematic view about the handled tool of the present invention.

Referring to FIG. 5, the application of the present invention is illustrated. In the present invention, the coarse section 24 and the extending unit 3 having a rectangular cross section have the effect of securing the driving portion 2 and extending unit 3 firmly to the handle portion 4 so has a concrete structure. The annular portion 25 has the effect of retaining the enclosing cover 41 without sliding.

Figure 6:
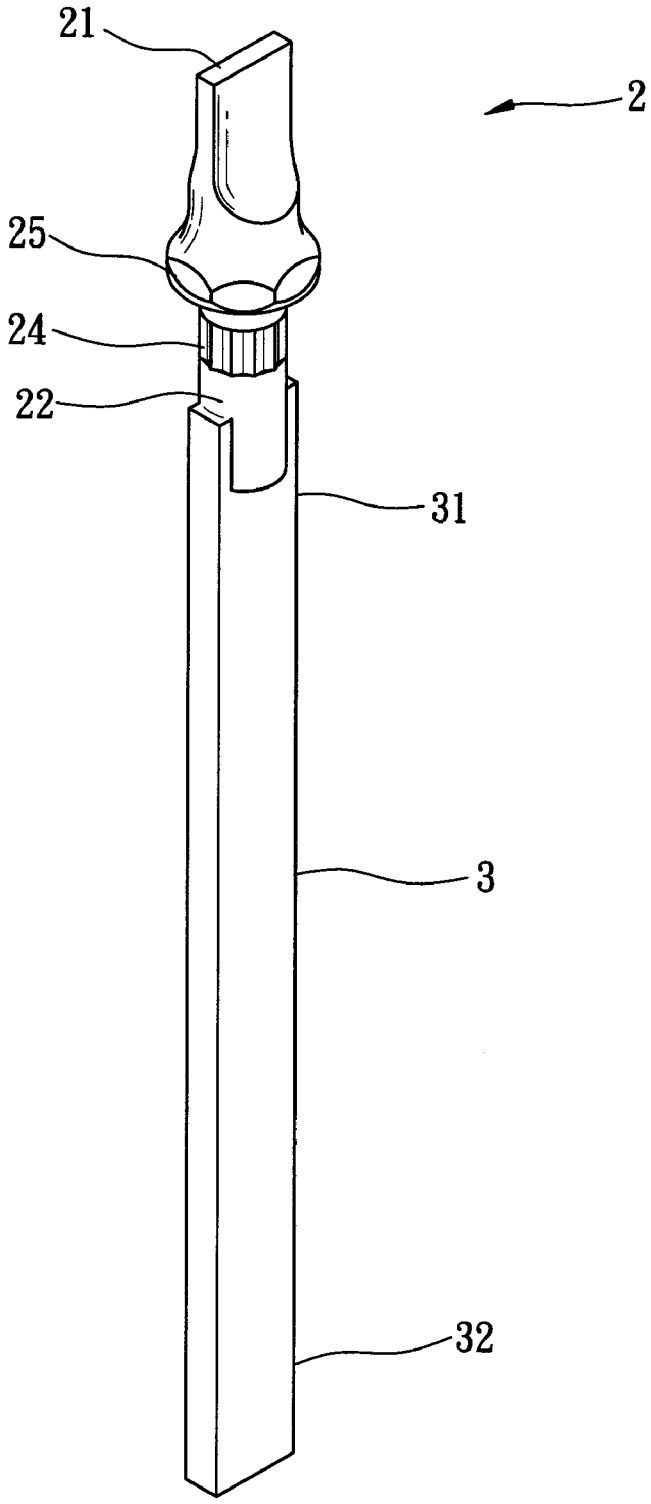
FIG. 6 is a schematic view about the second embodiment of the present invention.

Referring to FIG. 6, another embodiment of the present invention is illustrated. In this embodiment, those identical to the first embodiment will not be further described herein. Only those differences are disclosed.

Figure 7:
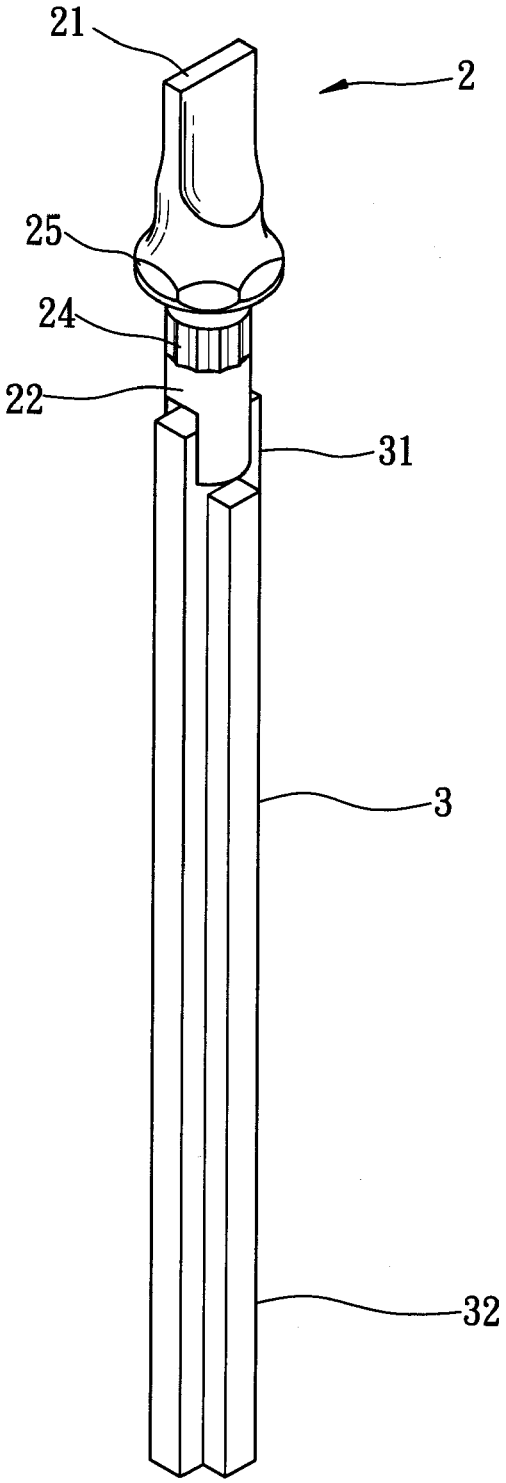
FIG. 7 is a schematic view about the third embodiment of the present invention.

In that, the driving portion 2 is integral formed with the extending unit 3. Referring to FIG. 7, in this embodiment, those identical to the first embodiment will not be further described herein. Only those differences are disclosed. In this embodiment, the extending unit 3 has a cruciform cross section.

Figure 8:
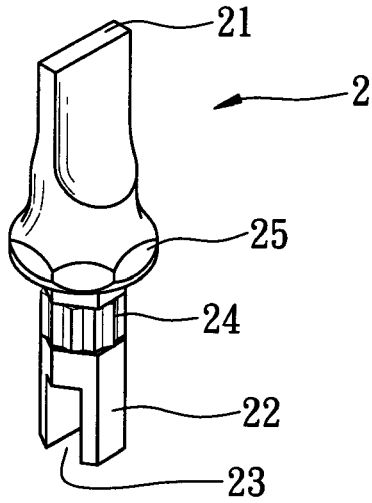
FIG. 8 is a schematic view about the fourth embodiment of the present invention.

With reference to FIG. 8, in this embodiment, those identical to the first embodiment will not be further described herein. Only those differences are disclosed. In this embodiment, the connecting end 22 of the driving portion 2 has a hexagonal cross section, or other regular form.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A handled tool with a firm structure, comprising:

a driving portion having a driving end and a connecting end; the driving end being an operation end of the handled tool; an enlarged annular portion being below the driving end; a coarse section being between the annular portion and the connecting end;

an extending unit being a rod with rectangular cross section; the extending unit having a first extending end and a second extending end; the first extending end being connected to the driving portion; and a handle portion having an enclosing cover and a handle, in assembly, the first extending end of the extending unit being combined to the connecting end of the driving portion; the second extending end of the extending unit being received in the handle portion; the enclosing cover enclosing a portion of the extending unit protruded from the handle portion and a portion of the driving portion below the annular portion of the driving portion so that the annular portion will rest against an upper edge of the enclosing cover.

2. The handled tool as claimed in claim 1, wherein a distal end of the connecting end having a concave embedding groove with a rectangular cross section; and the first extending end of the extending unit being received in the embedding groove of the driving portion.

3. The handled tool as claimed in claim 1, wherein the driving portion and the extending unit are integrally formed.

4. The handled tool as claimed in claim 2, wherein connecting end of the driving portion has a round cross section.

5. The handled tool as claimed in claim 3, wherein connecting end of the driving portion has a round cross section.

6. The handled tool as claimed in claim 2, wherein the extending unit has a cruciform cross section.

7. The handled tool as claimed in claim 3, wherein the extending unit has a cruciform cross section.

8. The handled tool as claimed in claim 1, wherein the driving end is a straight end opener.

9. The handled tool as claimed in claim 1, wherein the enclosing cover and handle are made integrally by molding injection so that the enclosing cover and handle are formed as an integral body.

10. The handled tool as claimed in claim 2, wherein the extending unit has a rectangular cross section.

11. The handled tool as claimed in claim 3, wherein said extending unit has a rectangular cross section.

* * * * *